US009057510B2

(12) United States Patent
Karlsson et al.

(10) Patent No.: US 9,057,510 B2
(45) Date of Patent: Jun. 16, 2015

(54) SUSPENSION DEVICE

(75) Inventors: Bo Karlsson, Torslanda (SE); Niclas Hedell, Höviksnäs (SE)

(73) Assignee: Bo Fastening AB, Västra Frölunda (SE)

( * ) Notice: Subject to any disclaimer, the term of this patent is extended or adjusted under 35 U.S.C. 154(b) by 257 days.

(21) Appl. No.: 13/514,390

(22) PCT Filed: Dec. 6, 2010

(86) PCT No.: PCT/EP2010/068936

§ 371 (c)(1), (2), (4) Date: Jun. 7, 2012

(87) PCT Pub. No.: WO2011/069945

PCT Pub. Date: Jun. 16, 2011

(65) Prior Publication Data

US 2012/0241579 A1 Sep. 27, 2012

(30) Foreign Application Priority Data

Dec. 8, 2009 (SE) ..... 0901535

(51) Int. Cl.
*B42F 13/00* (2006.01)
*F21V 21/16* (2006.01)
(Continued)

(52) U.S. Cl.
CPC ..... *F21V 21/16* (2013.01); *Y10T 29/49826* (2015.01); *F21S 8/06* (2013.01); *F21V 21/096* (2013.01); *F21Y 2103/00* (2013.01); *G09F 7/20* (2013.01); *G09F 2007/1852* (2013.01); *G09F 2007/186* (2013.01)

(58) Field of Classification Search
USPC ..... 248/343, 285, 317, 320, 324, 206.5, 248/489, 495, 323; 40/600, 617; 52/38, 39; 29/428
See application file for complete search history.

(56) References Cited

U.S. PATENT DOCUMENTS 4,191,352 A * 3/1980 Schuplin ..... 248/317
4,567,682 A * 2/1986 Hurxthal ..... 40/617
(Continued)

FOREIGN PATENT DOCUMENTS

DE 20320035 U1 5/2004
DE 10 2005 032799 A1 8/2006
EP 1624429 A2 2/2006

OTHER PUBLICATIONS

EPO, Int'l Search Rpt in PCT/EP2010/068936, May 26, 2011.

*Primary Examiner* — Monica Millner
(74) *Attorney, Agent, or Firm* — Piedmont Intellectual Property

(57) ABSTRACT

A suspension device (101) for suspending objects (102), such as light fittings, at a distance from a ceiling (103). The suspension device comprises at least one rod member (104) and one flexible suspension line (105), wherein the rod member (104) is longer than 250 mm. The rod member has at least one attachment means (106) for at least one magnetic fastener (107, 108), and at least one alignment means (109) for slidably suspending (Z1) an upper portion (105') of the suspension line relative to the longitudinal direction of the rod member. The suspension device further comprises at least one suspension means (110) for connection to both the suspension line (105) and the object (102), and a length-adjusting device (111) for adjusting the length (L1) of the suspension line between the rod member (104) and the suspension means (110).

15 Claims, 2 Drawing Sheets

(51) Int. Cl.

| | |
|---|---|
| ***F21V 21/096*** | (2006.01) |
| ***G09F 7/20*** | (2006.01) |
| *F21S 8/06* | (2006.01) |
| *F21Y 103/00* | (2006.01) |
| *G09F 7/18* | (2006.01) |

(56) References Cited

U.S. PATENT DOCUMENTS

| | | | | |
|---|---|---|---|---|
| 5,090,145 | A * | 2/1992 | Chiang et al. | 40/605 |
| 5,188,332 | A * | 2/1993 | Callas | 248/544 |
| 5,381,991 | A | 1/1995 | Stocker | |
| 5,499,789 | A * | 3/1996 | Rose | 248/489 |
| 5,529,274 | A * | 6/1996 | Anderson et al. | 248/329 |
| 5,870,845 | A * | 2/1999 | Ruderman et al. | 40/601 |
| 6,048,010 | A * | 4/2000 | Stocker | 294/103.1 |
| 6,257,418 | B1 * | 7/2001 | Allen et al. | 211/1.3 |
| 6,327,803 | B1 * | 12/2001 | Ruderman | 40/601 |
| 6,334,602 | B1 * | 1/2002 | Clarke | 248/495 |
| 6,591,528 | B2 * | 7/2003 | Ellingsen | 40/601 |
| 6,591,529 | B1 * | 7/2003 | Lane | 40/617 |
| 6,701,650 | B1 * | 3/2004 | Cieciuch et al. | 40/601 |
| 6,708,939 | B2 * | 3/2004 | Walker | 248/323 |
| 6,802,145 | B2 * | 10/2004 | Sparkowski | 40/617 |
| 7,086,190 | B2 * | 8/2006 | Voluckas | 40/617 |
| 7,213,938 | B2 * | 5/2007 | Brondt et al. | 362/225 |
| 7,249,743 | B1 * | 7/2007 | Stearns | 248/329 |
| 7,743,541 | B2 * | 6/2010 | Suciu et al. | 40/658 |
| 7,845,609 | B2 * | 12/2010 | Bernard | 248/328 |
| 7,895,784 | B1 * | 3/2011 | Clark et al. | 40/617 |
| 7,971,842 | B2 * | 7/2011 | Burrous et al. | 248/317 |
| 2002/0195531 | A1 * | 12/2002 | Walker | 248/228.4 |
| 2005/0001136 | A1 * | 1/2005 | Fleishman | 248/489 |
| 2005/0160648 | A1 * | 7/2005 | Voluckas | 40/617 |
| 2007/0209261 | A1 * | 9/2007 | Stover et al. | 40/617 |
| 2008/0029674 | A1 * | 2/2008 | Stearns | 248/329 |
| 2008/0169403 | A1 * | 7/2008 | Rooney | 248/343 |
| 2008/0202007 | A1 * | 8/2008 | Suciu et al. | 40/658 |
| 2008/0283708 | A1 * | 11/2008 | Bernard | 248/343 |
| 2009/0320339 | A1 * | 12/2009 | Burrous et al. | 40/479 |

* cited by examiner

SUSPENSION DEVICE

TECHNICAL FIELD

The present invention relates to a suspension device for suspending objects, such as light fittings, at a distance from a ceiling. The invention also relates to a use of the suspension device for suspending such objects.

BACKGROUND OF THE INVENTION

In shops, supermarkets, office premises and industrial halls, there is often a to need to be able to suspend light fittings over a certain floor position, and at a certain height from the floor, to obtain the desired illumination of the room. Usually, the suspension takes place by suspending the fittings by lines or wires from a false ceiling that consists of a framework of metal profiles with ceiling panels fitted into the framework. A problem with such a suspension is that the ceiling panels, as a rule, have a bending resistance that is too low to allow the suspension lines to be attached directly to the panels, since this would result in sagging of the ceiling, for which reason the suspension lines have to be attached to the framework of metal profiles. Light fittings should normally be aligned in a certain fashion in the horizontal plane, and should maintain this alignment also after installation. In order to be able to attain the desired alignment stability for a mounted light fitting, several suspension points in the metal profiles of the false ceiling and several suspension lines are required for each light fitting. In order to enable the light fitting to be suspended at an optional distance from the floor and in a desired alignment relative to the floor plane, preferably in parallel thereto, each suspension line either has to be equipped with a suitable length-adjusting device or cut to length during the installation.

In rooms without a false ceiling, light fittings can be suspended directly from the ceiling. Also in this case it has to be possible to attach the suspension lines to sufficiently bending resistant portions of the ceiling, for example to roof beams or beam elements of a corrugated sheet metal roof. With suspension devices according to prior art, it is often difficult or impossible to attach the suspension lines at optimal points in the ceiling, and to simultaneously get the light fitting suspended over a desired floor position in the room in an angularly stable manner, without requiring a plurality of suspension lines and length-adjusting devices, or cutting to length of the suspension lines before the suspension.

SUMMARY OF THE INVENTION

It is therefore a first object of the invention to provide a suspension device which enables an angularly stable and cheap suspension of objects, such as light fittings, at a distance from a ceiling, wherein the suspension can easily be carried out while adapting to optimal attachment points in the ceiling, and with a desired, substantially permanent alignment and height of the light fitting relative to a floor plane, without requiring several suspension lines with individual length-adjusting devices or cutting to length of suspension lines before the suspension, and which furthermore enables an angularly stable suspension of smaller objects from a single attachment point in the ceiling.

This first object is achieved by means of a suspension device according to claim 1, which comprises at least one rod member and only one flexible suspension line, wherein the rod member is longer than 250 mm and has at least one attachment means for at least one magnetic fastener, and at least one alignment means for slidably suspending an upper portion of the suspension line relative to the longitudinal direction of the rod member, and wherein the suspension device further comprises at least one suspension means for connection to both the suspension line and the object, and a length-adjusting device for adjusting the length of the suspension line between the rod member and the suspension means.

A second object of the invention is to indicate a particularly advantageous use of the device as above for quick, simple and inexpensive suspension of objects at a distance from a ceiling.

This object is achieved by means of a use where the suspension is accomplished by using a suspension device comprising at least one rod member and one flexible suspension line, and in that at least one magnetic fastener is magnetically attached to a metal surface at a desired position in the ceiling or a false ceiling below the ceiling, that said magnetic fastener is connected to at least one attachment means of the rod member, that an upper portion of the suspension line is slidably suspended relative to the rod member from at least one alignment means of the rod member, that a lower portion of the suspension line is connected to the object by means of at least one suspension means, that the length of the suspension line between the rod member and the suspension means is adjusted by means of a length-adjusting device intended for this purpose, and that the object is moved to the intended alignment and/or height relative to a floor surface by sliding adjustment of the upper portion of the suspension line relative to the rod member and/or by sliding adjustment of the lower portion of the suspension line relative to the longitudinal direction of the suspension means, while the suspension line extends in a closed loop.

Other objects, advantages and features of the present invention will become apparent from the following description.

BRIEF DESCRIPTION OF THE DRAWINGS

In the following, a number of embodiments of the invention will be described more closely, only as examples and with reference to the accompanying schematic drawings, in which.

DESCRIPTION OF EMBODIMENTS OF THE INVENTION

Figure 1:
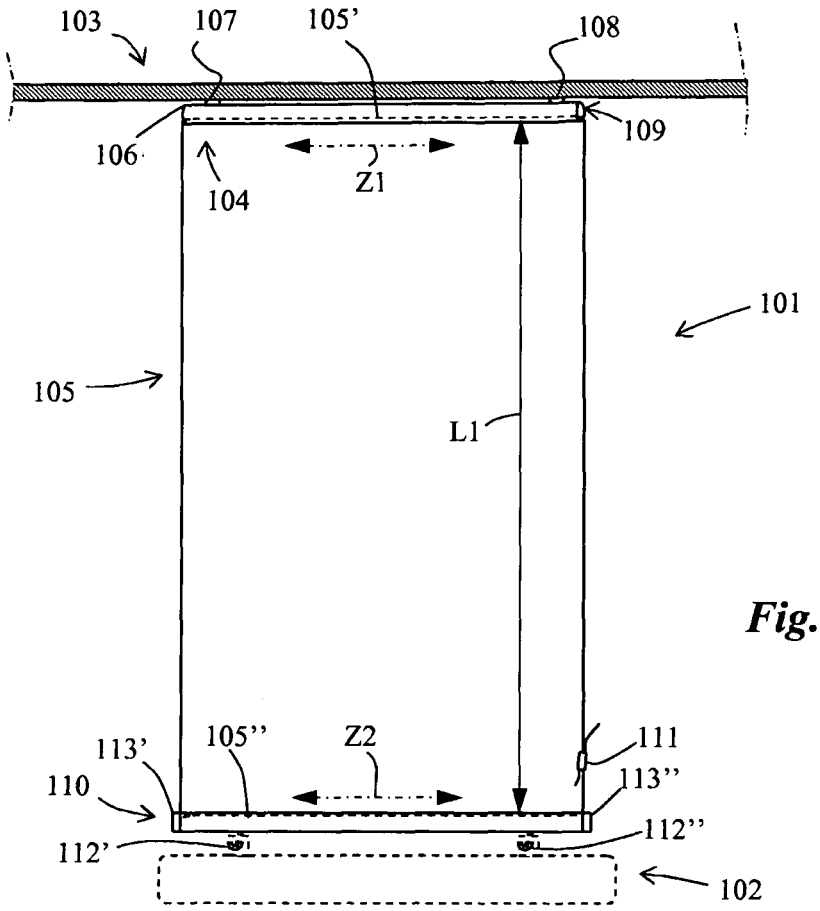
FIG. 1 is a schematic illustration of a suspension device according to a preferred embodiment of the invention, suspended from metal profiles of a ceiling.
Figure 2:
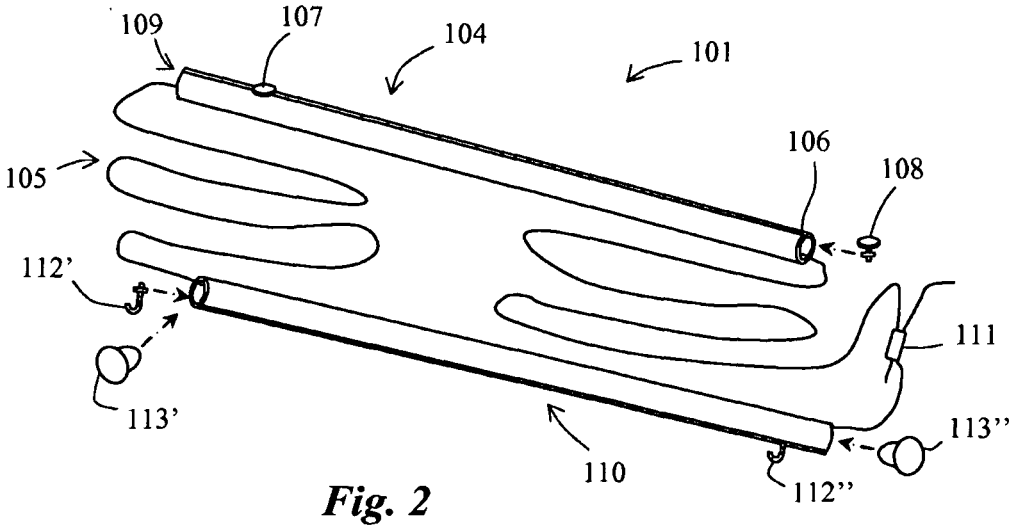
FIG. 2 shows a schematic perspective view of a suspension device according to the preferred embodiment, before starting the suspension.

FIG. 1 is a schematic illustration of a suspension device according to a preferred embodiment of the invention, which is suspended from metal profiles of a ceiling, whereas FIG. 2 shows a schematic perspective view of such a suspension device before starting the suspension.

The suspension device 101 according to the invention is intended for suspending objects 102 at a distance from a ceiling 103. This should be understood as if the suspension device can be suspended directly from a ceiling, from a false ceiling below the ceiling, or from another suitable supporting structure in the room where the suspension device is used. The suspension device is preferably designed for suspending light fittings, such as fluorescent tube fittings. However, the suspension device can be used for suspending any other type of objects, as long as they are not too heavy or bulky. Examples of such objects are different types of information and advertising signs, visual display units and information displays.

The suspension device 101 according to the invention comprises at least one to rod member 104 and one flexible suspension line 105. The flexible suspension line 105 is preferably a steel wire, but can also be a wire, thread, line, or cord of another material. The rod member 104 is made of a material of high rigidity and low weight, preferably an aluminium profile, but also rod members of plastic material, composite material, or wood can be used. Preferably, the rod member 104 has a bending resistance which, after suspension of an intended object 102, results in a deflection of no more than 1 centimeter/meter if the rod member is suspended rigidly fixed at only one of its ends.

According to the invention, the rod member 104 is longer than 250 millimeters, which is necessary to be able to obtain sufficient alignment stability of a typical suspended object, such as a fluorescent tube fitting. The rod member has at least one attachment means 106 for at least one magnetic fastener 107, 108. In the preferred embodiment in FIG. 1, the attachment means consists of a slot shape 106 in the rod member, into which a head portion of one or several magnetic fasteners 107, 108 (two in FIG. 1) can be slidably inserted from one end of the rod member. In the preferred embodiment, the magnetic fasteners 108 comprise a plate-shaped permanent magnet for magnetic coupling to a metal surface of a ceiling or false ceiling, a shank having one end attached to the permanent magnet and the other end provided with a head, wherein the head has shape adapted to be engaged by the above-mentioned slot shape 106 in the rod member 104.

According to the invention, the rod member further has at least one alignment means 109 for slidably suspending (symbolized by the arrow Z1 in FIG. 1) an upper portion 105' of the suspension line relative to the longitudinal direction of the rod member. In the preferred embodiment shown in FIGS. 1 and 2, the alignment means consists of a longitudinal channel 109 through the rod member for slidably receiving the upper portion 105' of the suspension line.

The suspension device 101 according to the invention further comprises at least one suspension means 110 for connection to both the suspension line 105 and the object 102, and a length-adjusting device 111 for adjusting the length L1 of the suspension line between the rod member 104 and the suspension means 110. The suspension means preferably consists of an elongated body having a bending resistance which results in a deflection of no more than 1 centimeter/meter if the elongated body is suspended rigidly fixed at only one of its ends. In the preferred embodiment shown in FIG. 1, the suspension means consists of an elongated profile 110, preferably of aluminium, having a longitudinal channel adapted for slidable passage of a lower portion 105" of the suspension line. In the preferred embodiment, the elongated profile 110 is provided with at least one suspending member 112', 112" for connection to the object 102. In the embodiment shown in FIGS. 1 and 2, the suspending members are constituted of two hooks 112', 112", which can be slidably inserted into a slot directed toward the intended bottom side of the elongated profile 110, to then be connected to apertures or loops of the object that is to be suspended. However, many other designs of the suspending members 112', 112" are conceivable, as long as they are adapted to mating surfaces or members of the objects which are to be suspended.

In the preferred embodiment shown in FIG. 1, the suspension line 105 is adapted to extend in loop that is closed by the length-adjusting device 111 after the suspension. In the preferred embodiment, all adjustment of the alignment and height above a floor surface of the suspended object takes place by means of this length-adjusting device 111, with simultaneous slidable adjustment Z1, Z2 of the upper line portion 105' relative to the rod member 104 and the lower line portion 105" relative to the suspension means 110. In the embodiment in FIGS. 1 and 2, the length-adjusting device is a wire lock 111 with two sets of internal locking tongues which enable the closed loop 105 of the suspension line too be shortened in two different directions by two mechanisms similar to those in so-called bundle straps and with a possibility of unlocking the length-adjusting device with a pointed tool, if a lengthening of the line loop is necessary. However, many other alternative designs of the length-adjusting device are conceivable, for example such ones where the line ends are fixed in a desired position relative to each other by means of clamping between metal tongues, clamping by screwing, and the like.

Preferably, the rod member and/or the suspension means is/are provided with fixing means 113', 113" for non-slidably fixing the suspension line relative to the rod member and/or the suspension means. In the embodiment shown in FIGS. 1 and 2, the fixing means consist of two caps 113', 113" adapted for application to a respective end of the suspension means 110 with the suspension line passing between the respective ends and respective caps. If necessary, similar fixing means can also be applied to the ends of the rod member 104 in order to ensure that the alignment of the object cannot be disturbed after the suspension.

Figure 3:
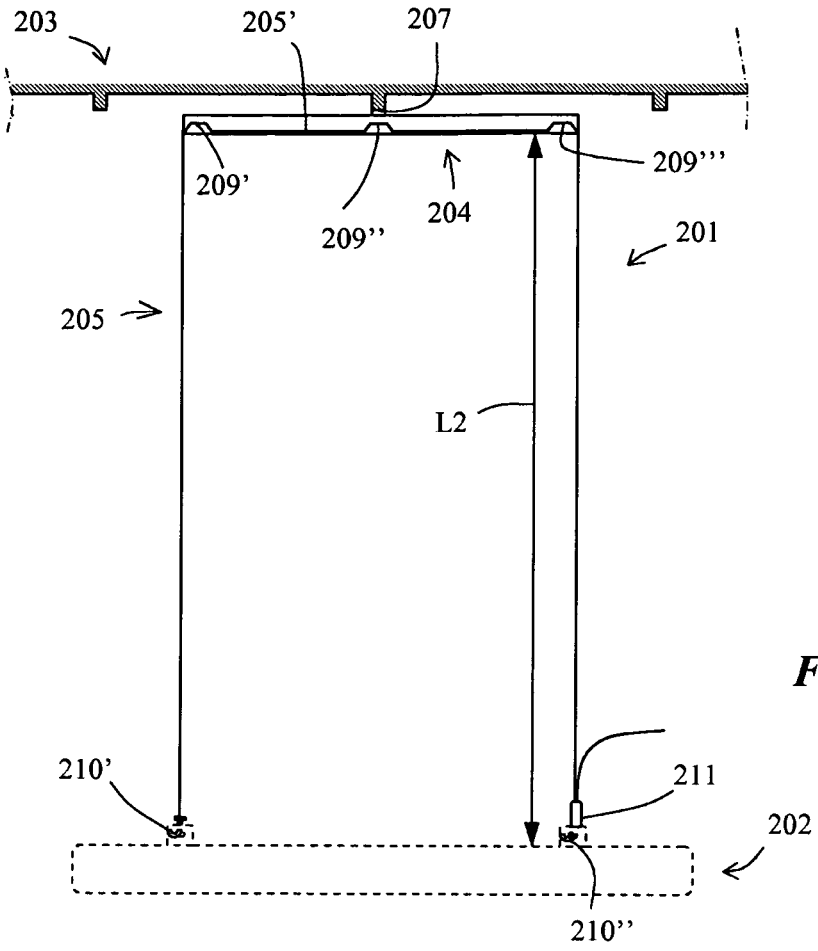
FIG. 3 is a schematic illustration of a suspension device according to an alternative embodiment of the invention, suspended from beam elements of a corrugated metal sheet roof.
Figure 4:
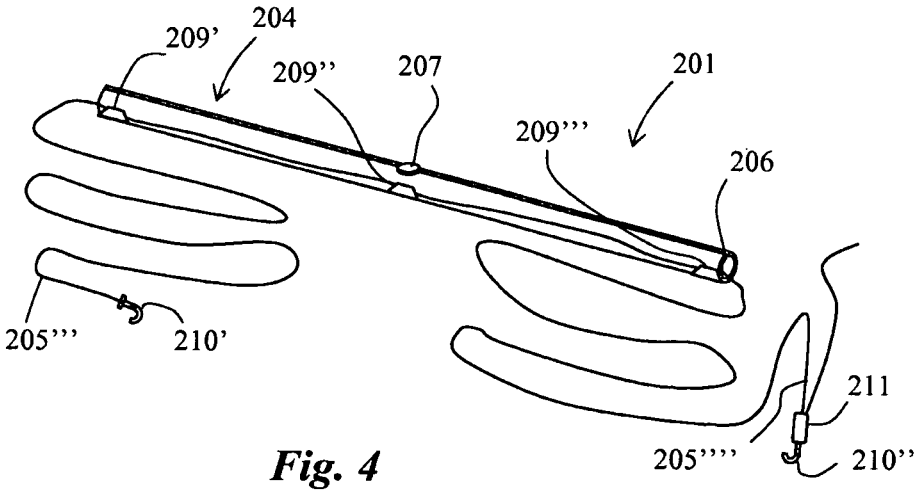
FIG. 4 shows a schematic perspective view of the suspension device according to the alternative embodiment, before starting the suspension.

FIGS. 3 and 4 show schematic illustrations of a suspension device according to an alternative embodiment of the invention. The suspension device 201 according to the alternative embodiment comprises at least one rod member 204 and one flexible suspension line 205. As in the previously described embodiment, the rod member 204 is longer than 250 millimeters, and has an attachment means in the form of slot shape 206 for at least one magnetic fastener 207, which in the embodiment in FIG. 3 is a single, plate-shaped permanent magnet 207 that is suspended from a beam element of a sheet metal roof. As is evident from FIG. 3, the suspension device according to the invention thus enables suspension of objects, such as lighter fluorescent tube fittings, from a single attachment point in a ceiling, in a false ceiling, or in another structure below the ceiling.

Instead of a through-going channel (109 in FIGS. 1 and 2), the suspension device 201 according to the alternative embodiment in FIGS. 3 and 4 has alignment means in form of three hook means 209', 209", 209'", which are arranged along the rod member for slidably suspending the upper portion 205' of the suspension line. The hook means are designed as metal tongues which, after the suspension of the object, can clamp the upper portion 205' of the suspension line in the desired position when desirable. The alignment means of the rod member in the alternative embodiment in FIGS. 3 and 4 thus also serve as fixing means 209', 209", 209'" for non-slidably fixing the suspension line 205' relative to the rod member 204.

Also in the alternative embodiment, the suspension device 201 comprises at least one suspension means 210', 210" for connection to both the suspension line 205 and the object 202. In the embodiment shown in FIGS. 3 and 4, the suspension means comprises two hook-shaped attachment elements 210', 210" which are fixed to a respective end 205'", 205"" of the suspension line and adapted for connection to the object 202.

Finally, the suspension device 201 according to the alternative embodiment comprises a length-adjusting device 211 for adjusting the length L2 of the suspension line between the rod member 204 and the suspension means 210', 210". In the alternative embodiment, the length-adjusting device is a wire lock 211 that enables the closed loop 205 of the suspension line to be shortened in only one direction, wherein the wire lock 211 has furthermore been integrated with one of the hook-shaped attachment elements 210".

In the alternative embodiment, the suspension line 205 is thus adapted to extend in loop, after the suspension of the object 202, which is closed by the length-adjusting device 211 together with the suspension means (the attachment elements 210', 210") and the object 202, which in the embodiment shown in FIG. 3 is a fluorescent tube fitting indicated by dashed lines. This means that the adjustment of the height and alignment of the fluorescent tube fitting in connection with the suspension takes place by means of the length-adjusting device 211 with simultaneous slidable adjustment of the upper portion 205' of the suspension line relative to the rod member 204, after which the position of the upper line portion 205' relative to the rod member 204 and thereby the height and alignment of the fluorescent tube fitting 202 can be non-slidably fixed by means of the combined alignment and fixing means 209', 209", 209'" on the rod member 204.

In the following, a particularly advantageous use of the device as above for quick, simple and cheap suspension of objects at a distance from a ceiling will be described with reference to FIG. 1.

This use comprises that the suspension of objects takes place by means of a suspension device 101 comprising at least one rod member 104 and one flexible suspension line 105, and in that at least one magnetic fastener 107, 108 is magnetically attached to a metal surface at a desired position in the ceiling or a false ceiling below the ceiling, that said magnetic fastener 107, 108 is connected to at least one attachment means 106 of the rod member 104, that an upper portion 105' of the suspension line 105 is slidably suspended relative to the rod member from at least one alignment means 109 of the rod member, that a lower portion 105" of the suspension line 105 is connected to the object 102 by means of at least one suspension means 110, that the length L1 of the suspension line between the rod member 104 and the suspension means 110 is adjusted by means of a length-adjusting device 111 intended for this purpose, and that the object 102 is moved to the intended alignment and/or height relative to a floor surface by sliding adjustment Z1 of the upper portion 105' of the suspension line relative to the longitudinal direction of the rod member 104 and/or by sliding adjustment Z2 of the lower portion 105" of the suspension line relative to the longitudinal direction of the suspension means 110, while the suspension line 105 extends in a closed loop.

In the foregoing, a number of embodiments of the invention have been described with reference to the figures in the accompanying drawings. It should be understood that the described embodiments and the details in the figures should only be regarded as examples, and that many other embodiments of the invention are possible within the scope of the following claims.

Accordingly, the rod member's attachment means 106; 206 for magnetic fasteners 107, 108; 207 do not at all have to be constituted of a slot shape for receiving a head portion of the fasteners, but can instead, for example, be constituted of hooks, loops, apertures or adhesive points interacting with mating members or corresponding surfaces of the magnetic fasteners.

Furthermore, the suspension device according to the invention can be used in other places than in business or office premises, such as in airport terminals, train stations, bus terminals, and other public buildings and then advantageously for suspending information displays, visual display units and similar objects. The suspension device according to the invention can also advantageously be used for suspending paintings and other art objects in art galleries or museums.

Although it is not evident from the accompanying figures, it is conceivable with embodiments of the invention where the suspension means consists of a straight rod of a suitable material, around which hooks of the object are hung, or embodiments where the suspension means comprises a single or several interacting sheet metal profiles bent to a V-shape. Furthermore, it is conceivable with embodiments where the length-adjusting device is a wire lock attached directly to a fluorescent tube fitting or another object which is to suspended, and where the suspension means consists of a single attachment element that is adapted for connection to the object and attached to the end of the suspension line that is not passing through the length-adjusting device. In such an embodiment, the attachment element can consist of a slotted plate washer thread onto a wire end, having a bulge that retains the plate washer, wherein the plate washer can inserted into a recess or slot in the object which is to be suspended for connection thereto.

The invention claimed is:

1. A suspension apparatus for suspending objects at a distance from a ceiling, comprising:

one flexible suspension line and at least one rod member, at least one suspension device for connection to both the suspension line and the object, and a length-adjusting device for adjusting the length of the suspension line between the rod member and the suspension device, wherein the rod member is longer than 250 millimeters and has at least one attachment device for at least one magnetic fastener, and at least one alignment device configured for slidably suspending an upper portion of the suspension line relative to a longitudinal direction of the rod member, and the alignment device comprises a longitudinal channel through the rod member for slidably receiving an upper portion of the suspension line.

2. The suspension apparatus of claim 1, wherein the rod member has a bending resistance which, after suspension of an intended object, results in a deflection of not more than 1 centimeter/meter if the rod member is suspended rigidly fixed at only one of its ends.

3. A suspension apparatus for suspending objects at a distance from a ceiling, comprising:

one flexible suspension line and at least one rod member, at least one suspension device for connection to both the suspension line and the object, and a length-adjusting device for adjusting the length of the suspension line between the rod member and the suspension device, wherein the rod member is longer than 250 millimeters and has at least one attachment device for at least one magnetic fastener, and at least one alignment device configured for slidably suspending an upper portion of the suspension line relative to a longitudinal direction of the rod member, and the suspension line is adapted to extend in a loop that is closed by the length-adjusting device after the suspension.

4. The suspension apparatus of claim 3, wherein the suspension line is adapted to extend in a loop that is closed by the length-adjusting device together with at least one of the suspension device and the object after the suspension.

5. The suspension apparatus of claim 1, wherein the suspension device includes an elongated body having a bending resistance which results in a deflection of not more than 1 centimeter/meter if the elongated body is suspended rigidly fixed at only one of its ends.

6. The suspension apparatus of claim 1, wherein the suspension device includes an elongated profile having a longitudinal channel adapted for slidable passage of a lower portion of the suspension line.

7. The suspension apparatus of claim 1, wherein the suspension device includes an elongated profile provided with at least one suspending member for connection to the object.

8. The suspension apparatus of claim 1, wherein the suspension device comprises at least one attachment element fixed to one end of the suspension line and adapted for connection to the object.

9. The suspension apparatus of claim 1, wherein the suspension device includes at least one of suspending members and attachment elements adapted for connection to a light fitting.

10. The suspension apparatus of claim 3, wherein the alignment device comprises at least two hook devices arranged along the rod member and configured for slidably suspending an upper portion of the suspension line.

11. The suspension apparatus of claim 1, wherein the attachment device for the at least one magnetic fastener comprises a slot in the rod member, the slot configured for slidable insertion of a head portion of at least one magnetic fastener from one end of the rod member.

12. The suspension apparatus of claim 1, wherein a magnetic fastener comprises a plate-shaped permanent magnet for magnetic coupling to a metal surface of a ceiling or false ceiling, a shank having one end attached to the permanent magnet and another end provided with a head having a shape adapted to be engaged by a slot in the rod member.

13. The suspension apparatus of claim 1, wherein at least one of the rod member and the suspension device includes a fixing device configured for non-slidably fixing the suspension line relative to the rod member or the suspension device.

14. The suspension apparatus of claim 13, wherein the fixing device includes a cap adapted for application to an end of the rod member or suspension device, with the suspension line passing between the end and the cap.

15. A method of using a suspension apparatus for suspending objects at a distance from a ceiling, the suspension apparatus having at least one rod member and one flexible suspension line, comprising:

attaching at least one magnetic fastener to a metal surface at a desired position in the ceiling, the magnetic fastener being connected to at least one attachment device on the at least one rod member;

slidably suspending an upper portion of the suspension line relative to the rod member from at least one alignment device of the rod member, a lower portion of the suspension line being connected to the object by at least one suspension device, and adjusting a length of the suspension line between the rod member and the suspension device by a length-adjusting device, wherein the object is moved to an intended alignment or height relative to a floor surface by sliding adjustment of an upper portion of the suspension line relative to a longitudinal direction of the rod member or by sliding adjustment of the lower portion of the suspension line relative to the longitudinal direction of the suspension device, with the suspension line extending in a closed loop and the upper portion of the suspension line being slidably received in a longitudinal channel through the rod member.

* * * * *